US005363887A

United States Patent [19]

Haeberli

[11] Patent Number: 5,363,887

[45] Date of Patent: Nov. 15, 1994

[54] PROCESS AND MACHINE FOR FILLING CONTAINERS WITH COSMETIC PRODUCTS

[75] Inventor: Adrian Haeberli, Zurich, Switzerland

[73] Assignee: Aktiengesellschaft Für Geld-Und Kapitalanlagen, Samedan, Switzerland

[21] Appl. No.: 33,885

[22] Filed: Mar. 18, 1993

[30] Foreign Application Priority Data

Mar. 18, 1992 [IT] Italy ..... MI92A000628

[51] Int. Cl.[5] ..... B65B 1/20

[52] U.S. Cl. ..... 141/12; 141/102; 141/121; 141/125; 141/280; 100/226; 53/529; 53/438

[58] Field of Search ..... 141/8, 12, 71, 72, 73, 141/74, 75, 76, 77, 78, 79, 80, 81, 67, 101, 102, 256, 258, 121, 125, 131, 180, 280, 282, 281, 283, 163, 144, 86, 87, 311 A; 100/222, 226, 246; 53/529, 438, 122; 222/109, 318

[56] References Cited

U.S. PATENT DOCUMENTS

| | | | |
|---|---|---|---|
| 1,437,876 | 12/1922 | Tyler | 141/315 |
| 3,405,744 | 10/1968 | Bowman | 141/12 |
| 3,656,517 | 4/1972 | Taylor et al. | 141/67 |
| 3,847,191 | 11/1974 | Aronson | 141/71 |
| 4,020,881 | 5/1977 | Nöthen | 141/163 |
| 4,501,307 | 2/1985 | Moser et al. | 141/71 |
| 4,594,066 | 6/1986 | Graham | 141/71 |

FOREIGN PATENT DOCUMENTS

| | | |
|---|---|---|
| 0310472 | 4/1989 | European Pat. Off. . |
| 2478669 | 9/1981 | France . |
| 2481060 | 10/1981 | France . |

OTHER PUBLICATIONS

Patent Abstracts of Japan, vol. 10, no. 194 (C-358)8, Jul. 1986.

*Primary Examiner*—Henry J. Recla
*Assistant Examiner*—Steven O. Douglas
*Attorney, Agent, or Firm*—Jacobson, Price, Holman & Stern

[57] ABSTRACT

A machine for filling containers with cosmetic products including a support device (3) having a cosmetic powder receiving station and an outlet, a homogenizing and feeding device (1, 2, 20) for depositing cosmetic powder onto the support device at the receiving station, a leveling device (4) for forming the cosmetic powder into a layer having a predetermined height, a tablet forming station, a tablet forming device movably mounted (5) relative to the support device for pressing portions (12) of the layer into tablets of cosmetic product and withdrawing the formed tablets from the layer at the tablet forming station, a discharge station for receiving the tablets in respective tablet containers (14), guides (5) for supporting the tablet forming device for movement between the tablet forming station and the discharge station, a discharge device (11) for ejecting the tablets from the tablet forming device into the respective containers at the discharge station, a collection sump (15) at the outlet of the support device for receiving excess cosmetic powder from the support device after formation of the tablets, and a conducting device for conducting excess cosmetic powder from the collection sump device to the homogenizing and feeding device.

14 Claims, 3 Drawing Sheets

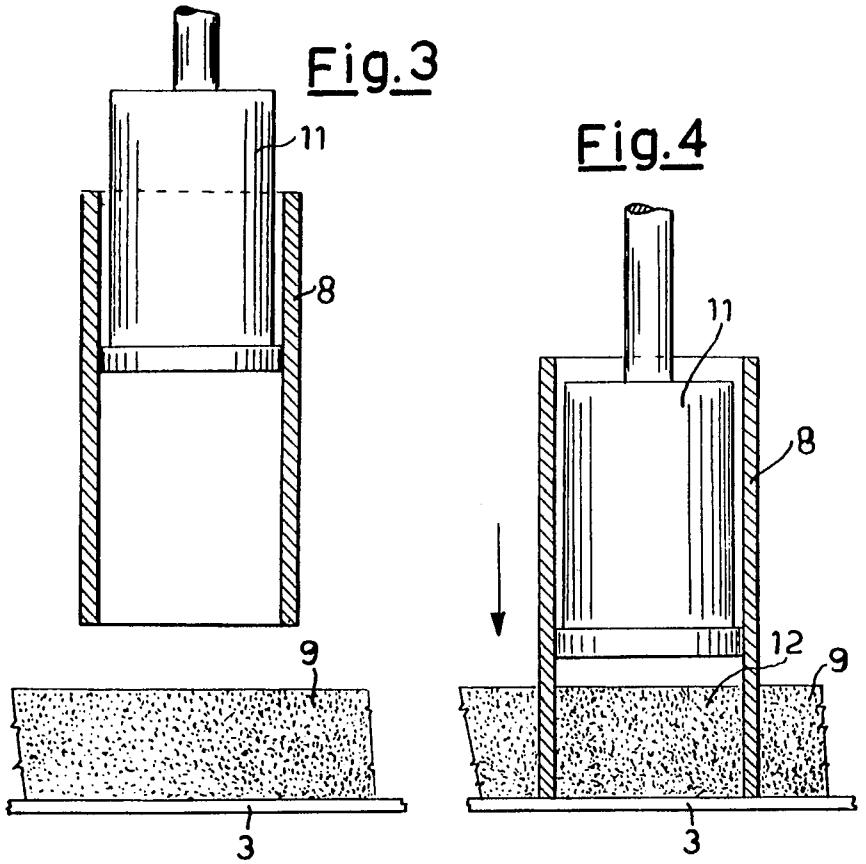
Fig.3
11
8
9
3
Fig.4
11
8
12
9
3
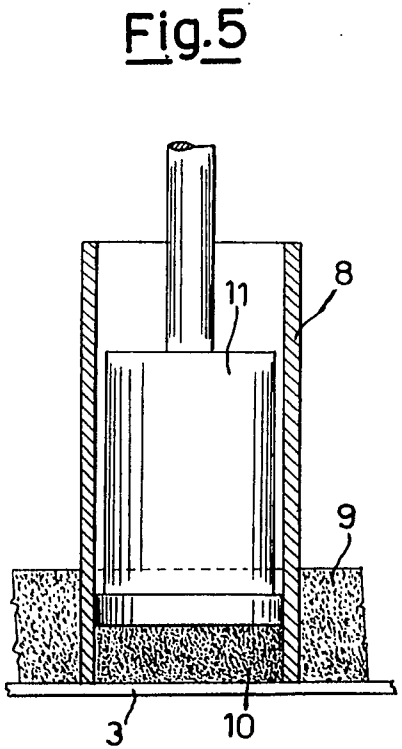
Fig.5
11
8
9
10
3
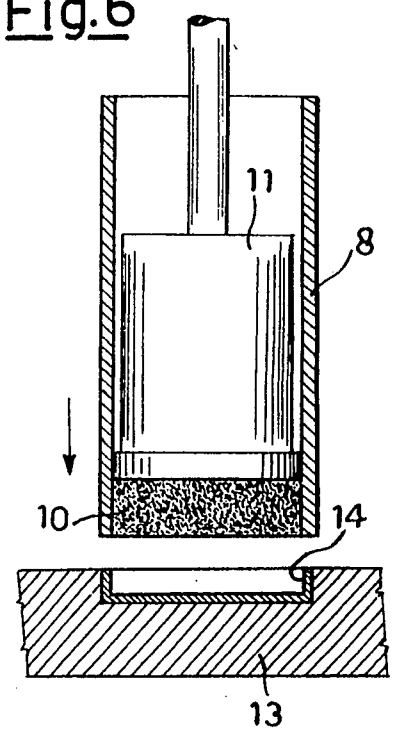
Fig.6
11
8
14
13
10

FIG. 7
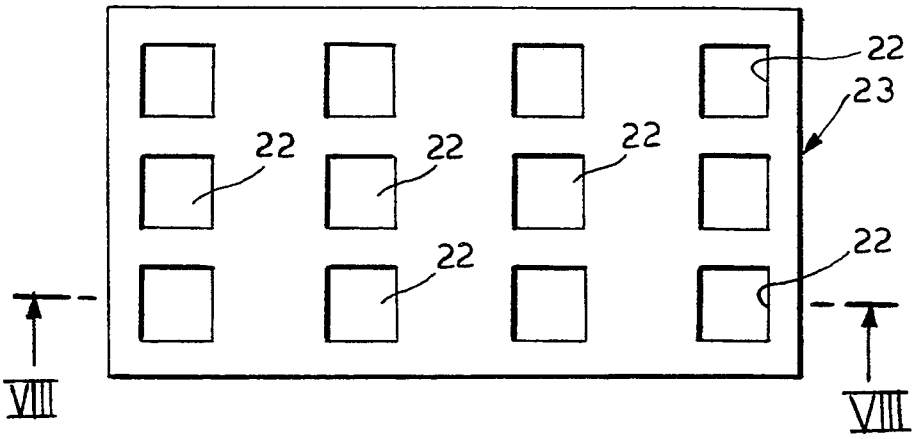
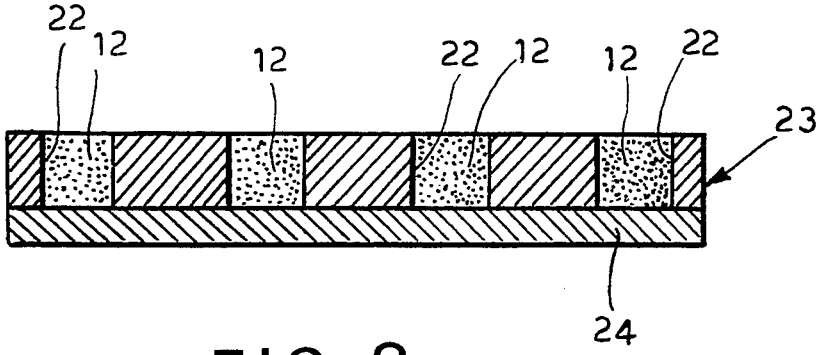
FIG. 8

PROCESS AND MACHINE FOR FILLING CONTAINERS WITH COSMETIC PRODUCTS

BACKGROUND OF THE INVENTION

The present invention relates to a process and a machine for filling containers with cosmetic products.

Machines are known for filling containers with compacted cosmetic powders, that provide for successive processing steps corresponding to the deposit of a given quantity of cosmetic powder in a container and to pressing it by means of mechanical pressing systems.

Again according to the known art the metering of cosmetic powder takes place, for example, by manually depositing the cosmetic powder on a metal surface provided with a number of cavities each containing a metal or plastic container.

In this case, since the fall of the cosmetic powder takes place by gravity, its distribution in the containers takes place in an entirely casual manner. The subsequent removal of the excess powder, accomplished by means of a special scraper system, must be carried out several times and thus causes clotting of the product or haloes i.e., differentiated zones around the central parts that later are very obvious in the finished product and frequently jeopardizes its use.

In a more sophisticated manner the metering of the cosmetic powder in the container takes place through the use of loading screw feeders or hoppers above the metal surface.

Such ponderal, i.e., heavy, metering devices, to be able to work, must be contained in variously-shaped metal cylinders and in these the drop of the powders cannot be directed homogeneously to all points, especially in the case of irregular and complex shades.

As a consequence, in the step of pressing for the formation of the finished product, the surface powder contained in the container is at a different level and exhibits a lack of homogeneousness of the cosmetic features as regards the preparation and the resistance to a fall.

BRIEF SUMMARY OF THE INVENTION

The object of the present invention is to overcome the abovementioned drawbacks by providing a machine that guarantees the homogeneousness of the cosmetic product (in powder form or also as dried mud) inside a container and the uniformity of its surface distribution.

According to the invention such object is attained with a process for filling containers with cosmetic products, characterized in that it comprises the formation of a layer of cosmetic product of a predetermined height, the pressing of portions of the layer for the formation of corresponding tablets of cosmetic and the withdrawal and transfer of the tablets in respective containers.

According to an embodiment of the process according to the invention the layer of cosmetic product is formed in a continuous layer that can subsequently be apportioned.

According to another embodiment of the process according to the invention the layer of cosmetic product is formed in distinct portions already prepared for the subsequent operation of pressing and withdrawal.

According to the invention such object is also attained with a machine for execution of the abovementioned process characterized in that it comprises means for feeding a cosmetic product on a support for the formation of a layer of cosmetic product of a predetermined height and a device for the withdrawal and pressing of portions of the layer for the formation of tablets of cosmetic product, suitable for moving between a position of formation and withdrawal of the tablets and a position of discharge of the tablets in respective containers.

Downstream from the support, constituted, say, by a conveyor belt, there is preferably a sump for collecting excess cosmetic product that is subsequently brought back to the means for feeding the cosmetic product.

A suitable pressing means is also preferably installed for the final pressing of the tablets in the container.

BRIEF DESCRIPTION OF THE DRAWINGS

The features of the present invention will be made more evident by the following detailed description of its embodiments with reference to the non-limiting examples in the accompanying drawings, wherein:

FIGS. 3, 4, 5, 6 are enlarged cross-sectional views which illustrate in successive operating positions the details of the means for the withdrawal and pressing of a tablet of cosmetic product;

FIG. 7 is a top plan view of a part of the machine according to a variant of the embodiment illustrated in FIG. 1; and FIG. 8 is cross sectional view taken along the line VIII—VIII of FIG. 7.

DETAILED DESCRIPTION

Figure 1:
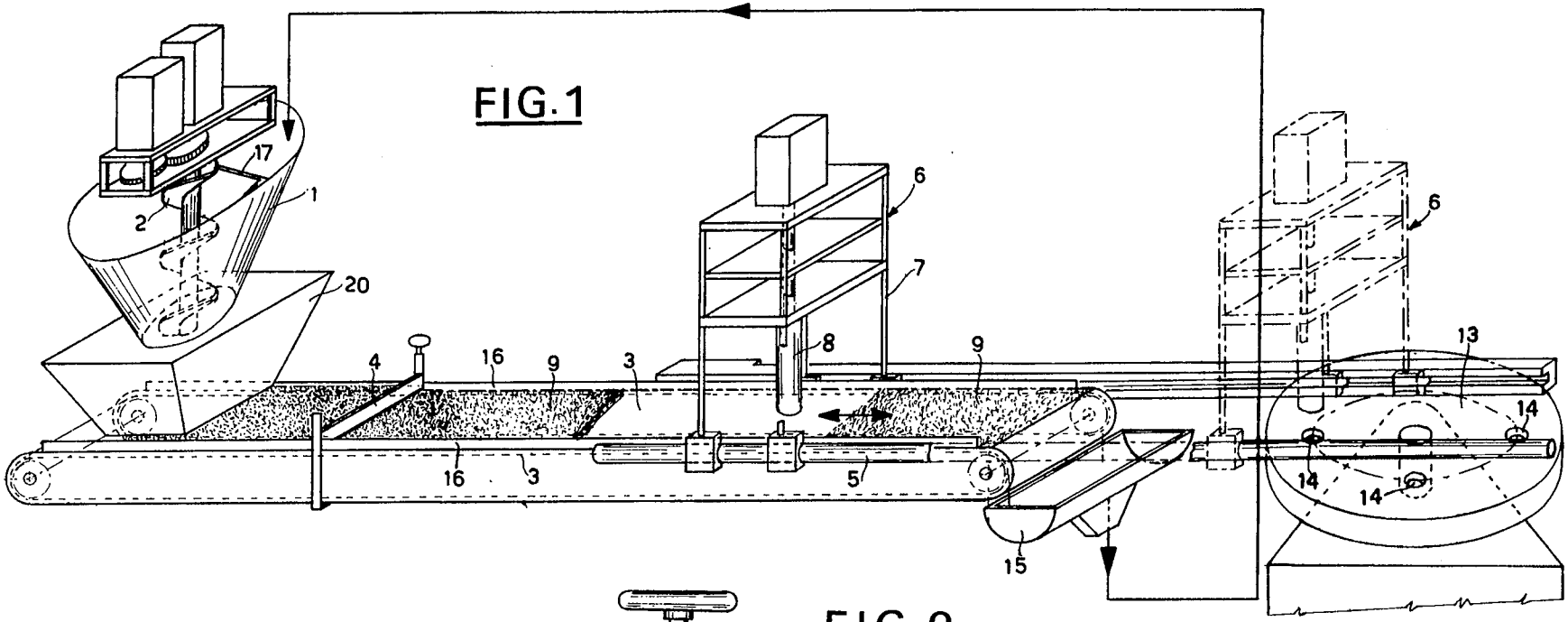
FIG. 1 is perspective view of a machine according to the invention.
Figure 2:
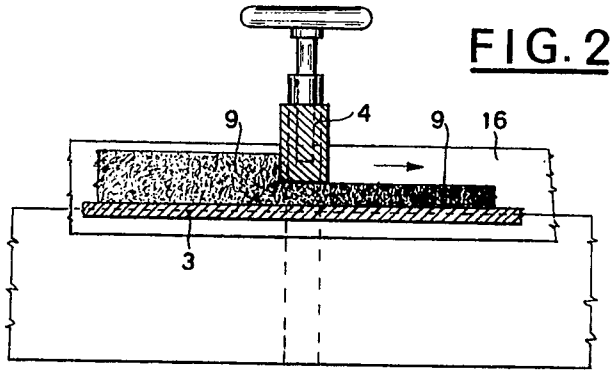
FIG. 2 is a cross-sectional view of a part of the machine of FIG. 1 for metering the cosmetic product before its withdrawal and pressing in the collection container.

With reference to FIG. 1, there is shown a machine according to the invention that comprises a hopper 1, inside which, by rotation, a screw 2 feeds cosmetic powder to a hopper 20 underneath and then to a conveyor belt 3 and a means for homogenizing the cosmetic powder, such as the stirrer 17. The conveyor belt 3 is provided with lateral shoulders 16 for containing the cosmetic powder falling upon it.

Along the conveyor belt 3, at a certain distance from the hopper 1, there is an adjustable plate 4 that executes the levelling of the cosmetic powder for the formation of a continuous layer 9 of cosmetic powder of a predetermined height.

To the sides of the conveyor belt 3 there is a pair of guides 5 for the sliding movement of a device 6 that withdraws and presses portions 12 of the layer 9 for the formation of tablets 10 of cosmetic powder. The device 6 consists of a frame 7 supporting a metal die 8, inside which a piston 11 slides.

The machine also comprises a rotating support 13 for containers 14 suitable for being filled with respective tablets 10.

Between the conveyor belt 3 and the rotating support 13 there is a collection sump 15 for any excess cosmetic powder.

In operation, cosmetic powder is fed by the rotation of the screw 2 inside the hopper 1 onto the conveyor belt 3 and is homogenized by the stirrer 17 so as to form a continuous layer 9 of homogeneous and soft product that can be apportioned. The width of the layer 9 is kept constant by the lateral containment shoulders 16 associated with the conveyor belt 3.

During its translation, the layer 9 meets the levelling plate 4, that reduces its height to a desired level and also exerts upon it a first pressure, that makes its density uniform.

The layer 9 then slides toward the withdrawal and pressing device 6 for the formation of the tablets 10.

The device 6 operates as follows. As illustrated in FIGS. from 3 to 6, starting from its position over the conveyor belt 3 (FIG. 3), the metal die 8 is lowered (FIG. 4) so as to separate a portion 12 of cosmetic powder from the layer 9. As illustrated in FIG. 5, the piston 11 is in turn lowered so as to compress the portion 12 to obtain a tablet 10. The die 8 is then raised from the layer 9 and takes with it the tablet 10 held by its side walls. The device 6 then translates along the guides 5 to a position where it discharges the tablet 10 in a corresponding container 14. This position is illustrated in FIG. 6 and in dot-and-dash line in FIG. 1. Then the means 6, without the tablet 10, returns to the initial position, illustrated with full lines in FIG. 1, for the withdrawal of a new tablet 10.

In the meantime the rotating support 13 rotates so as to position an empty container 14 in the position of loading a new tablet 10.

When all the containers 14 in the rotating support 13 have been filled with tablets 10, a further pressing means, not shown, executes the final pressing of the tablets 10.

The homogeneousness is thus ensured of the cosmetic powder in the containers 14 as well as the uniformity of its surface distribution, both flat and corrugated.

The use of this machine guarantees the complete utilization of the cosmetic powder. All residues of cosmetic powder that do not contribute to the formation of the tablets 10 are collected, as production proceeds, in a collection sump 15 and fed again to the hopper 1 as indicated by the arrows of FIG. 1.

With the machine as described it is possible to obtain tablets consisting of a single cosmetic powder as well as tablets consisting of several cosmetic powders. This latter embodiment implies the delivery on the conveyor belt 3 of strips of different cosmetic powders.

Still with this machine it is also possible to obtain tablets of any desired height simply by varying the pressure exerted by the piston 11 on the portion 12 of the layer 9.

Although in the description of the embodiment shown in the drawings mention has always been made of cosmetic powder, it is finally clear that the machine as described can also readily be used for a cosmetic product in the form of mud or cream.

There is illustrated in FIGS. 7 and 8 a variant of the previous embodiment of the machine according to the invention.

In it, in place of the conveyor belt 3, there is a plate 23 closed at its lower end by a closing surface 24 and provided with cavities 22 inside which the cosmetic powder is poured and forms directly portions 12 of a fixed predetermined height. Subsequently the device 6 comes into action and, in the manner illustrated in FIGS. 5 and 6, presses the cosmetic powder of each portion 12 for the formation of a respective tablet 10 and transfers each tablet 10 to a corresponding container 14 of The rotating support 13.

It should be noted that in both embodiments described, as well as in others that fall within the scope of the invention, the containers 14 can be made of plastic and can be destined for sale directly.

The conveyor belt 3 of the embodiment of FIGS. 1–6 can in turn be replaced with a rotating carrousel, that can possibly comprise a plate with cavities like the one illustrated in FIGS. 7 and 8.

I claim:

1. A machine for filling containers with cosmetic products comprising:

support means having a cosmetic powder receiving station and an outlet;

means for homogenizing and feeding said cosmetic powder onto said support means at said receiving station;

means for forming said cosmetic powder into a layer having a predetermined height;

a tablet formation station;

a tablet forming device movably mounted relative to said support means for pressing portions of said layer to form tablets of cosmetic product and withdrawing said formed tablets from said layer at said tablet forming station;

a discharge station for receiving said tablets in respective tablet containers;

means for supporting said tablet forming device for movement thereof between said tablet forming station and said discharge station;

means for discharging said tablets from said tablet forming device into said respective containers at said discharge station;

collection sump means at said outlet of said support means for receiving excess cosmetic powder from said support means after said forming of said tablets; and means operatively connected between said collection sump means and said homogenizing and feeding means for conducting said excess cosmetic powder from said collection sump means to said homogenizing and feeding means.

2. The machine as claimed in claim 1 wherein:

said support means comprises a moving conveyor belt, said homogenizing and feeding means depositing a continuous layer of cosmetic powder on said conveyor belt; and said means for forming a layer of cosmetic powder in a predetermined height comprises leveling means mounted adjacent said conveyor belt and engaging said continuous layer of cosmetic powder for leveling said layer to said predetermined height.

3. The machine as claimed in claim 2 and further comprising:

final pressing means adjacent said discharge station for final pressing of said tablets in said containers.

4. The machine as claimed in claim 3 wherein said tablet forming device comprises:

a frame;

die means movably mounted on said frame for reciprocating movement reactive to said layer on said support means for insertion into said layer to separate said portions thereof; and piston means movable in said die means for movement relative thereto into engagement with said layer for pressing said cosmetic powder into said tablets.

5. The machine as claimed in claim 1 wherein said support means comprises:

a plate member;

a bottom forming a closed lower surface on said plate member; and a plurality of cavities in said plate member for receiving cosmetic powder from said homogenizing and feeding means and forming distinct portions of said layer.

6. The machine as claimed in claim 5 and further comprising:

final pressing means adjacent said discharge station for final pressing of said tablets in said containers.

7. The machine as claimed in claim 6 wherein said tablet forming device comprises:

a frame;

die means movably mounted on said frame for reciprocating movement reactive to said layer on said support means for insertion into said layer to separate said portions thereof; and piston means movable in said die means for movement relative thereto into engagement with said layer for pressing said cosmetic powder into said tablets.

8. The machine as claimed in claim 1 and further comprising:

final pressing means adjacent said discharge station for final pressing of said tablets in said containers.

9. The machine as claimed in claim 1 wherein said tablet forming device comprises:

a frame;

die means movably mounted on said frame for reciprocating movement relative to said layer on said support means for insertion into said layer to separate said portions thereof; and piston means movable in said die means for movement relative thereto into engagement with said layer for pressing said cosmetic powder into said tablets.

10. A machine for filling containers with cosmetic products comprising:

conveyor belt means for conveying cosmetic powder being movable along a path and having a cosmetic powder receiving station associated therewith;

feeding means for feeding cosmetic powder onto said conveyor belt means at said receiving station;

leveling means adjacent said conveyor belt means downstream of said receiving station engageable with said cosmetic powder on said conveyor belt means for leveling said cosmetic powder to define a layer of cosmetic powder having a predetermined height;

a tablet forming station;

a tablet forming and transfer device positioned adjacent said conveyor belt means downstream of said leveling means for separating and pressing portions of said layer of cosmetic powder into tablets of cosmetic product at said tablet forming station and for picking up and transferring said tablets from said conveyor belt means into respective containers a discharge station positioned downstream of said tablet forming station for receiving said tablets formed by said tablet forming and transfer device in said respective tablet containers; and an outlet for said conveyor belt means downstream of said tablet forming station for removing residual cosmetic powder from said conveyor belt means.

11. The machine as claimed in claim 10 and further comprising:

a collection sump at said outlet of said conveyor belt means for collecting residual cosmetic powder from said conveyor belt means; and recycling means operatively connected between said collection sump and said feeding means for returning said residual cosmetic powder from said sump to said feeding means.

12. The machine as claimed in claim 10 and further comprising:

final pressing means adjacent said discharge station for final pressing of said tablets in said containers.

13. The machine as claimed in claim 12 wherein said tablet forming and transfer device comprises:

movable die means mounted for reciprocating movement relative to said layer of cosmetic powder on said conveyor belt means for insertion into said layer to separate said portions thereof and retraction from said layer; and piston means slidingly mounted in said die means for movement relative thereto into engagement with said layer for pressing said portions of said cosmetic powder into said tablets when said die means is inserted into said layer, said piston means being retracted with said retraction of said die means, said tablets being frictionally held by said die means during said retraction.

14. The machine as claimed in claim 10 wherein said tablet forming and transfer device comprises:

movable die means mounted for reciprocating movement relative to said layer of cosmetic powder on said conveyor belt means for insertion into said layer to separate said portions thereof and retraction from said layer; and piston means slidingly mounted in said die means for movement relative thereto into engagement with said layer for pressing said portions of said cosmetic powder into said tablets, when said die means is inserted into said layer, said piston means being retracted with said retraction of said die means, said tablets being frictionally held by said die means during said retraction.

* * * * *